United States Patent [19]

Hawie

[11] Patent Number: 4,463,482

[45] Date of Patent: Aug. 7, 1984

[54] FASTENER

[75] Inventor: Robert L. Hawie, Stratford, Conn.

[73] Assignee: The Hawie Mfg. Co., Bridgeport, Conn.

[21] Appl. No.: 421,031

[22] Filed: Sep. 22, 1982

[51] Int. Cl.[3] ..... A44B 21/00

[52] U.S. Cl. ..... 24/489; 24/498; 24/515; 24/517

[58] Field of Search ..... 24/248 R, 248 E, 250, 24/201 C

[56] References Cited

U.S. PATENT DOCUMENTS

| | | | |
|---|---|---|---|
| 517,278 | 3/1894 | Hoyt | 24/250 |
| 722,308 | 3/1903 | Kemper | 24/250 |
| 803,535 | 10/1905 | Greenblatt et al. | 24/250 |
| 834,493 | 10/1906 | Rubin | 24/250 |
| 873,967 | 12/1907 | Sturm et al. | 24/250 |
| 1,377,116 | 5/1921 | Delcourt | 24/248 E |
| 1,382,484 | 6/1921 | Delcourt | 24/248 E |
| 2,219,991 | 10/1940 | Hawie | 24/250 |
| 2,394,204 | 2/1946 | Randall | 24/250 |
| 2,837,806 | 6/1958 | Hawie | 24/250 |
| 3,914,828 | 10/1975 | Noda | 24/250 |

FOREIGN PATENT DOCUMENTS

| | | | |
|---|---|---|---|
| 979870 | 1/1965 | United Kingdom | 24/250 |
| 1048215 | 11/1966 | United Kingdom | 24/250 |

*Primary Examiner*—Victor N. Sakran

*Attorney, Agent, or Firm*—Thomas L. Tully

[57] ABSTRACT

A releasable compression fastener, such as a clip for use on a garter belt, suspenders, or the like, The fastener has a pair of jaws comprising a base plate designed to be connected to a material, such as a suspender strap, and a flexible clamping plate. An actuating means is attached to the base plate, the latter being adapted to releasably flex the clamping plate against the base plate to close the jaws and clamp a layer of flexible fabric therebetween. The invention involves the use of cooperating, integrating jaws comprising male and female members of specific structure on the base plate and clamping plate to provide integrating locking means for the flexible material clamped therebetween.

6 Claims, 5 Drawing Figures

FASTENER

BACKGROUND OF THE INVENTION

Fasteners comprising releasable clips for use on garter belts, suspenders, diapers, mittens, etc., have been known for over thirty years. Reference is made to Hawie U.S. Pat. Nos. 2,219,991 and 2,837,806, for example.

Conventional fasteners of this type comprise parts which are stamped from metal, including a base plate having an eyelet, wire loop or pin for attaching the fastener to one material, such as a suspender strap, a diaper or an elastic strip. A clamping jaw plate is pivotally-attached to the base plate and an actuating plate or lever is pivotally-attached to the base plate, overlying the clamping jaw, and adapted to move against the clamping jaw and cause the latter to move towards and releasably lock in closely-spaced parallel position relative to the opposed face of the base plate. The base plate and the clamping jaw were formed to have cooperating fabric-gripping teeth which close together to penetrate and grip the flexible fabric material over which the clip is placed and locked.

Conventional fastener clips of this type continue to be in widespread use, but they do have disadvantages, particularly when used in association with flexible fabrics which are thin, slippery or prone to tearing or to running. Unless the gripping teeth are sharp and tightly engaged, they will not hold a thin and/or slippery fabric such as silk or synthetic woven fabrics or plastic films against strong pulling forces. However, such sharp and tight teeth can cut the fabric, causing tears and runs. The teeth penetrate the fabric to provide spaced anchor points, and the pulling force against the fabric is concentrated at these anchor points to produce spaced areas of stress, each of which is isolated from the others so that no cooperative result is obtained.

It has been proposed to avoid the use of the conventional metal gripping teeth in clip fasteners by providing cooperative plastic gripping members on the opposed surfaces of the base plate and the clamping jaw plate, the gripping members having plastic teeth which come together to clamp a flexible fabric when the fastener is locked. While such plastic gripping members have smooth plastic teeth which do not cut through a flexible fabric in the same manner as the conventional sharp metal teeth, they have the important disadvantage of greater slip-permission and reduced holding power relative to thin and slippery flexible fabrics. Since the smooth plastic teeth do not penetrate the fabric to any substantial degree, they do not provide strong anchor points and, therefore, while a strong pulling force on the fabric will not usually result in tears or runs, it will cause the fabric to slip or creep from between the plastic teeth and out of engagement with the fastener clip.

SUMMARY OF THE INVENTION

The present invention relates to improved fasteners of the releasable clip type and, more particularly, to releasable compression fasteners in which the fabric-gripping means of the jaws cannot penetrate the flexible fabric to be retained, and which grip an area of the fabric rather than spaced points thereof and which cause any slippage of the gripped fabric to move the fabric towards a central area of the gripping means where the fabric bunches up or collects to form a fabric bulk which cannot enter the gripping means, thereby stopping any further slippage.

The novel gripping means of the present invention comprises opposed cooperative male and female members, one on the base plate and the clamping plate, respectively, the male member having a flat surface supporting a raised male projection having opposed extensions or arms which taper inwardly and downwardly towards the opening of the clip, i.e., towards the direction of pull exerted by a fabric clamped within the clip, and which come together to form a crotch having a "V" or "U" shape. The female member has a corresponding flat surface having a similarly-shaped recess which is adapted to admit the male projection and the clamped area of fabric, when the fastener is locked, to clamp the area of fabric between the flat surfaces of the male and female members and beneath the male projection within the recess and below the plane of the flat surface of the female member. Thus, an area of the fabric is gripped, and any slippage of the gripped fabric causes the fabric which is above the gripping members to travel inwardly and downwardly, following the taper of the extensions of the male member, and to collect or bunch up and form a bulk of fabric at the crotch of the extensions which cannot pass between the male projection and the female recess, thereby preventing any further slippage.

THE DRAWINGS

DESCRIPTION

Figure 1:
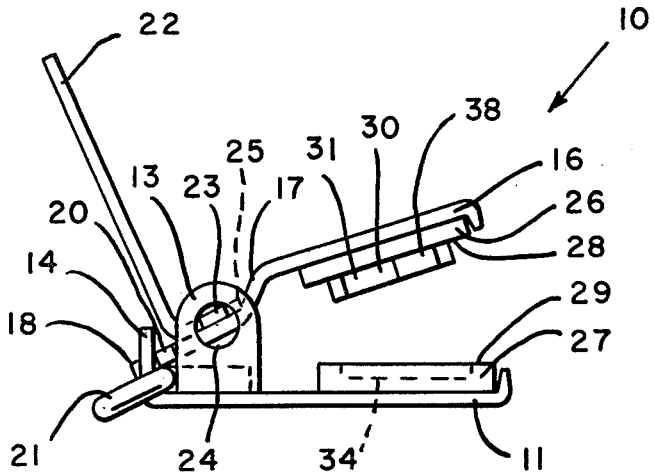
FIG. 1 is a side view of a fastener according to one embodiment of the present invention, the fastener being in open position.
Figure 2:
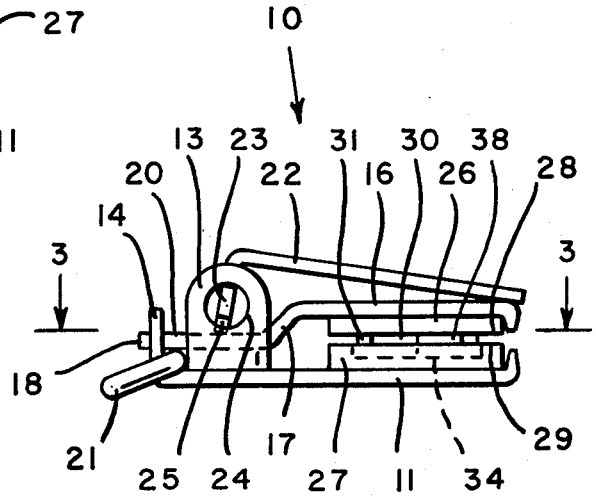
FIG. 2 is a side view of the fastener of FIG. 1 shown in closed, locked position.
Figure 3:
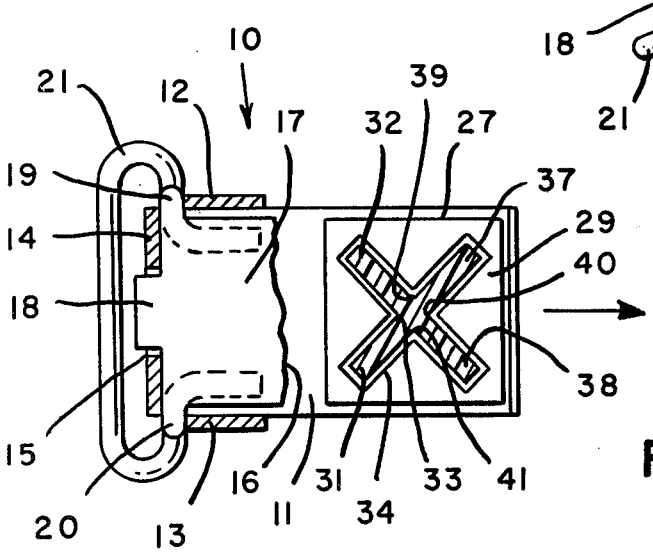
FIG. 3 is cross-sectional view taken along the line 3—3 of FIG. 2, and FIGS. 4 and 5 are plan views of female members illustrating recesses of different shapes which are suitable for use in place of the corresponding members of the fastener of FIGS. 1 to 3, the shape and dimensions of the corresponding male projections being illustrated by means of broken lines.

Referring to the drawing, FIGS. 1 to 3, the present releasable fastener clip 10 comprises a flat base plate 11 having upwardly extending side ears 12 and 13 and an upwardly extending rear wall 14 having a central slot 15. Clip 10 also comprises a flexible flat clamping plate 16 having an inclined rear portion 17 which terminates in a central projection 18 which is received within the slot 15 of the base plate 11, the rear portion 17 also having opposed side projections 19 and 20 which are confined between the ears 12 and 13 and the rear wall 14, respectively to hold the clamping plate 16 in alignment relative to the base plate 11. Confined between the clamping plate 16 and the base plate 11 in the area of the projections 19 and 20 is a metal wire loop 21 which is closed externally in order to permit engagement with a suspender strap, elastic strip or other fabric element, the open end of the loop 21 being shown by means of broken lines in FIG. 3. The presence of the loop 21 beneath the clamping plate 16 and the confinement of the projection 18 within slot 15 renders the flexible clamping plate 16 a spring when the front end thereof is depressed.

Such depression is made possible by an actuating member 22 which comprises a lever plate which is pivotally-attached to the base plate 11 by means of opposed side projections 23, each of which is confined with an opening 24 in the opposed ears 12 and 13. The actuating member 22 has a front handle portion and a rear, depening cam section 25 which is designed to contact and depress the clamping plate 16 when the handle portion is moved down against the upper surface of the clamping plate. Such depression causes the opposed surfaces of the clamping plate 16 and the base plate 11 to move towards each other in relatively parallel position.

The novel portions of the present fastener clip 10 are the jaws comprising the male member 26, which is fastened to or integral with the undersurface of the pressure plate 16, and the female member 27, which is fastened to or integral with the upper surface of the base plate 11, said members having flat outer surfaces, 28 and 29 respectively, which are positioned so as to come into closely-spaced or contact position with each other when the empty clip 10 is in closed position and which are designed to make engagement with a layer of fabric confined within the clip 10 during use.

The male member 26 comprises said flat surface 28 and an integral raised male projection 30 of uniform height above said surface 28, projection 30 having at least two extensions 31 and 32 in the direction away from each other and from the opening of the clip 10, said extensions tapering together in the direction of said opening to form a crotch 33 formed by the coming-together of said extensions 31 and 32.

The female member 27 comprises its flat surface 29 and a recess 34 therein which corresponds to the shape of the male projection 30 but which is slightly larger in width than the male projection 30 in all directions, in order to accommodate not only the male projection 30 but also at least a portion of the thickness of a layer of fabric confined between the male and female members when the clip 10 is closed. The depth of the female recess 34 preferably is less than the height of the male projection 30 in order to clamp an engaged fabric more tightly than said fabric is clamped between the flat surfaces 28 and 29.

Any pulling force against the layer of fabric confined within the jaws of the closed clip 10 from the direction opposed to the direction of insertion results in slippage of the fabric, if any, from between flat surfaces 28 and 29 which causes the fabric to move from both directions towards the crotch 33 of the male projection 30 confined within the female recess 34. Any such movement results in an accumulation and bunching of the fabric at the crotch 33, producing an increased thickness or bulk of fabric at such location. This distributes the strain on the fabric over a broader area of the fabric than is the case when fabric is gripped between spaced teeth, and prevents the fabric from slipping or creeping out of the grip of the extensions 31 and 32 since such extensions are unitary and are connected to each other in the area of crotch 33.

The preferred structure of the male projection 30 and the female recess 34 is shown in FIG. 3, wherein the X-shaped male projection 30 is omni-directional since it comprises four cooperating extensions 31, 32, 37 and 38 forming four V-shaped crotches 33, 39, 40 and 41. This provides the same fabric-bunching and locking effect discussed above but from all directions, i.e., against pulling from either side of the clip 10 and against movement of the fabric further into the jaws of the clip.

While the dimensions of the male and female members and the male projection and female recess may be varied depending upon the size of the fastener clip and its intended use, i.e., the nature and thickness of the fabric to be locked therein, the following dimensions are suitable in connection with fasteners illustrated by FIGS. 1 to 3. The male member 26 is about 0.45" square, about 0.05" thick, and the male projection 30 extends a uniform height of about 0.07" above the flat surface 28. The male projection 30 comprises uniform extensions 31, 32, 37 and 38 which extend at right angles relative to each other and which which have a width of about 0.07" each and a length from its crotch to tip of about 0.17". The female member 27 is also about 0.45" square, about 0.09" thick and the female recess 34 has a uniform depth of about 0.05" below the flat surface 29. The recess 34 has an enlarged shape corresponding to the X-shape of the male projection 30 so as to provide a uniform clearance of about 0.02 inch in width, i.e., each recess extension has a width of about 0.11". The length of each recess extension, from its crotch to tip, is about 0.15" to provide a clearance of about 0.01 inch between the end of each of the extensions 31, 32, 37 and 38 and the end of each of the recess extensions. The height of the male projection 30 is about 0.02" greater than the depth of the female recess 34 so that the top surface of the former compresses the engaged fabric against the floor of the latter more tightly than said engaged fabric is held between the flat surfaces 28 and 29. Such tight compression permits the actuating member 22 to be pivoted to locking position, shown by FIG. 2. In all cases, the height of the male projection 30 must be at least equal to and preferably slightly greater than the depth of the female recess 34. These dimensions are given by way of illustration and should not be considered limitative. The only other requirements is that the female recess must be at least slightly wider in all directions than the width of the male projection so as to permit the gripped area of the fabric to be depressed into the recess by the male projection.

Figure 4:
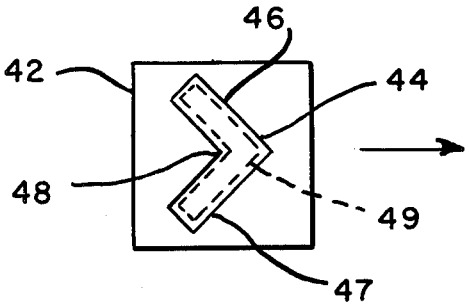
Figure 5:
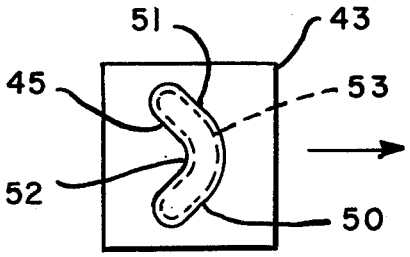

FIGS. 4 and 5 illustrate alternative female members 42 and 43 having recesses 44 and 45, respectively, which provide unidirectional holding power with respect to a layer of fabric gripped therein. The V-shaped recess 44 of FIG. 4 comprises recess extensions 46 and 47 which extend away from the opening of the fastener and which merge together in the direction of said opening to form a crotch 48. The width and shape of the companion male projection 49 is shown by means of broken lines.

The U-shaped recess 45 of FIG. 5 comprises extensions 50 and 51 which extend in a direction away from the opening of the fastener and which taper together in the direction of said opening to form a crotch 52. The width and shape of the companion male projection 53 is shown by means of broken lines.

It will be apprent to those skilled in the art, in the light of the present disclosure, that the present male and female members may be integral metal portions of the clamping plate and the base plate. However, preferably such members are molded from a plastic composition, such as nylon, and are attached to the clamping plate and the base plate, such as by means of a suitable adhesive or a rivet, to form the jaws of said plates.

Variations and modifications of the present invention will be apparent to those skilled in the art within the scope of the present claims.

I claim:

1. A releasable compression fastener having a pair of jaws designed to be clamped over a layer of flexible fabric inserted within the opening of said jaws comprising a base plate having an upper surface forming one said jaw, a flexible clamping plate pivotally-attached to said base plate and having an undersurface forming the other jaw of said pair, and an actuating cam member pivotally-attached to said base plate over said clamping plate and movable between a closed position in which it contacts and flexes said clamping plate against said base plate to close said pair of jaws, and an open position in which it releases contact with said clamping plate to permit said clamping plate to flex out of contact with said base plate to open said pair of jaws, characterized by one of said jaws comprising a male member having a flat surface supporting a male projection having at least two extensions which extend in directions away from each other and from the opening of said jaws and which taper together towards said opening to form a crotch, said male projection and extensions having a raised surface of uniform height above said flat surface, the other of said jaws comprising a female member having a flat surface and a recess in said flat surface, said recess being in alignment with and having a shape corresponding to said male projection and being slightly larger in width than said male projection to permit said male projection to depress a clamped area of flexible fabric within said recess when said fastener is in closed position, whereby a layer of flexible fabric clamped between said jaws is clamped between said flat surfaces of said male and female members and a portion thereof is clamped within said recess by said male projection, any slippage of the clamped fabric from between said flat surfaces in the direction of the opening of said jaws causing the fabric movement to be directed by the converging extensions of said male member and to accumulate at the crotch thereof in the form of a bulk of said fabric incapable of further slippage, whereby any strain on the clamped fabric is distributed over a broad area of the fabric.

2. A fastener according to claim 1 in which said male projection and said female recess are substantially X-shaped.

3. A fastener according to claim 1 in which said male projection and said female recess are substantially V-shaped.

4. A fastener according to claim 1 in which said male projection and said female recess are substantially U-shaped.

5. A fastener according to claim 1 in which said male member and said female member comprise plastic elements, one of which is attached to form the undersurface of said clamping plate and the other of which is attached to form the upper surface of said base plate.

6. A fastener according to claim 1 in which the height of said male projection above the flat surface of said male member is slightly greater than the depth of said female recess below the flat surface of said female member whereby a flexible fabric is clamped more tightly beneath said male member than between said flat surfaces.

* * * * *